US009093792B2

(12) United States Patent
Shiratori et al.

(10) Patent No.: US 9,093,792 B2
(45) Date of Patent: Jul. 28, 2015

(54) CONNECTOR AND SIGNAL TRANSMISSION METHOD USING THE SAME

(71) Applicant: Japan Aviation Electronics Industry, Limited, Tokyo (JP)

(72) Inventors: Masayuki Shiratori, Tokyo (JP); Shuichi Aihara, Tokyo (JP); Masayuki Katayanagi, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 5 days.

(21) Appl. No.: 14/069,648

(22) Filed: Nov. 1, 2013

(65) Prior Publication Data

US 2014/0235108 A1 Aug. 21, 2014

(30) Foreign Application Priority Data

Feb. 18, 2013 (JP) ..... 2013-029400

(51) Int. Cl.

| | |
|---|---|
| ***H01R 4/66*** | (2006.01) |
| ***H01R 13/652*** | (2006.01) |
| ***H01R 13/6471*** | (2011.01) |
| ***H01R 13/6474*** | (2011.01) |
| *H01R 12/57* | (2011.01) |
| *H01R 12/72* | (2011.01) |

(52) U.S. Cl.

CPC ..... *H01R 13/652* (2013.01); *H01R 13/6471* (2013.01); *H01R 13/6474* (2013.01); *H01R 12/57* (2013.01); *H01R 12/724* (2013.01); *H01R 2201/06* (2013.01)

(58) Field of Classification Search

CPC .. H01R 23/7073; H01R 23/688; H01R 43/16; H01R 23/005

USPC ..... 439/79, 101, 108, 660, 885, 941

See application file for complete search history.

(56) References Cited

U.S. PATENT DOCUMENTS 7,303,410 B2 * 12/2007 Saito ..... 439/108
7,448,884 B2 * 11/2008 Kato et al. ..... 439/108

(Continued)

FOREIGN PATENT DOCUMENTS

JP 2005-149770 A 6/2005
JP 3990355 B2 7/2007

(Continued)

OTHER PUBLICATIONS

Korean Office Action dated Feb. 17, 2015 in KR 10-2013-0141199 with English translation of relevant parts.

*Primary Examiner* — Thanh Tam Le

(74) *Attorney, Agent, or Firm* — Collard & Roe, P.C.

(57) ABSTRACT

A connector has a plurality of high-speed differential signal lanes each of which includes two first contacts for high-speed differential signal transmission and two ground contacts. A second contact which does not belong to the high-speed differential signal lanes is arranged between the high-speed differential signal lanes. On a first connection side for connection with a connecting object, contacting portions of the contacts are arranged in a single row at a distance from one another. On a second connection side for connection with a mounting object, terminal portions of the first contacts and terminal portions of the ground contacts are arranged in a first row at a distance wider than that between the contacting portions while a terminal portion of the second contact is arranged in a second row.

16 Claims, 9 Drawing Sheets

(56) References Cited

U.S. PATENT DOCUMENTS

| | | | | |
|---|---|---|---|---|
| 7,708,601 | B2 * | 5/2010 | Tanaka | 439/660 |
| 8,591,272 | B2 * | 11/2013 | Shiratori et al. | 439/885 |
| 8,894,451 | B2 * | 11/2014 | Shiratori et al. | 439/885 |
| 2005/0101163 | A1 | 5/2005 | Obikane et al. | |
| 2008/0014803 | A1 | 1/2008 | Kato et al. | |
| 2010/0330848 | A1 | 12/2010 | Kondo et al. | |

FOREIGN PATENT DOCUMENTS

| | | | |
|---|---|---|---|
| JP | 4439540 | B2 | 3/2010 |
| KR | 10-2011-0001866 | A | 1/2011 |
| WO | 02/101883 | A2 | 12/2002 |

* cited by examiner

CONNECTOR AND SIGNAL TRANSMISSION METHOD USING THE SAME

This application is based upon and claims the benefit to priority from Japanese patent application No. 2013-029400, filed on Feb. 18, 2013, the disclosure of which is incorporated herein in its entirety by reference.

BACKGROUND OF THE INVENTION

1. Field of the Invention

This invention relates to a connector and a signal transmission method using the same and, in particular, to a differential signal connector for use in connecting transmission lines for transmitting a differential signal pair and a signal transmission method using the differential signal connector.

2. Description of Related Art

There is known a differential transmission method of transmitting a differential signal pair comprising a pair of opposite-phase signals on paired two signal lines. The differential transmission method is capable of achieving high-speed data transmission and, therefore, is recently put into practical use in various fields.

For example, in case where the differential transmission method is used in data transmission between a device and a liquid crystal display, each of the device and the liquid crystal display is provided with a display port connector designed in conformity with a display port standard. As the display port standard, VESA Display Port Standard 1.0 and Version 1.1a thereof are known.

The display port connector is one type of a differential signal connector and has a first connection side for connection with a connecting object and a second connection side for connection with a printed board of the device or the liquid crystal display. The first connection side has a structure strictly determined by the display port standard because of the relationship with the connection object. On the other hand, the second connection side has a structure which is relatively free. The differential signal connector of the type is disclosed in Japanese Patent No. 4439540 (Patent Document 1) (corresp. to US2008/0014803A1).

As illustrated in FIG. 9, the connector disclosed in Patent Document 1 has, as a lower contact group, two pairs of signal contacts 121 and a plurality of ground contacts 122 arranged on opposite sides of each pair of the signal contacts 121.

On the first connection side, contacting portions 121A of the signal contacts 121 and contacting portions 122A of the ground contacts 122 are arranged in a single row at a predetermined distance D1 from one another, as shown in FIG. 9.

On the second connection side, terminal portions 121B of the signal contacts 121 are arranged in a first row R1 while terminal portions 122B of the ground contacts 122 are arranged in a second row R2 which is shifted from the first row R1.

With the above-mentioned arrangement, a distance D2 between the terminal portions 121B and 122B is greater than the distance D1 between the contacting portions 121A and 122A. Thus, it is intended to simultaneously achieve reduction in size of the connector and good mountability of the terminal portions 121B and 122B to through holes (not shown) which require a predetermined size and an arrangement at a predetermined distance.

However, in the connector disclosed in Patent Document 1, the terminal portions 121B of the signal contacts 121 and the terminal portions 122B of the ground contacts 122 are arranged in the different rows R1 and R2, respectively, and the distance D2 between the terminal portions 121B and 122B is wide. Therefore, characteristic impedances around the terminal portions 121B and 122B are higher than those around the other portions. In this event, characteristic impedance matching is difficult to achieve. This results in a problem that high-speed signal transmission (for example, transmission of 10 Gbps or higher-speed signals containing a frequency component at which it is appropriate to treat a connector or a contact as a distribution constant circuit) is difficult.

SUMMARY OF THE INVENTION

In order to solve the above-mentioned problem in the related art, it is an object of this invention to provide a connector which is capable of simultaneously achieving reduction in size of the connector and good mountability of the connector to a mounting object and which allows easy matching of characteristic impedances and is therefore excellent in high-speed signal transmission characteristic.

It is another object of this invention to provide a signal transmission method using the above-mentioned connector.

A connector of an aspect of the present invention is mounted to a mounting object and connected to a connecting object. The connector comprises: a plurality of high-speed differential signal lanes (GSSG) each of which is composed of two first contacts (S) adapted to high-speed differential signal transmission and arranged adjacent to each other and two ground contacts (G) sandwiching the two first contacts and arranged on opposite sides of the two first contacts, one on each side; and at least one second contact which is disposed between adjacent ones of the high-speed differential signal lanes and which does not belong to the high-speed differential signal lanes. Each of the first contacts, the ground contacts, and the second contact has a contacting portion to be connected to the connecting object and a terminal portion to be connected to a mounting object. The connector has a first connection side for connection with the connecting object, where the contacting portions of the first contacts, the contacting portions of the ground contacts, and the contacting portion of the second contact are arranged in a single row at a distance from one another. The connector has a second connection side for connection with the mounting object, where the terminal portions of the first contacts and the terminal portions of the ground contacts are arranged in a first row at a distance wider than that between the contacting portions while the terminal portion of the second contact is arranged in a second row different from the first row. According to this configuration of the connector, the above-mentioned objects are achieved.

A connector of another aspect of the present invention is mounted to a mounting object and connected to a connecting object. The connector comprising: a plurality of high-speed differential signal lanes each of which is composed of two first contacts arranged adjacent to each other and two ground contacts sandwiching the two first contacts and arranged on opposite sides of the two first contacts, one on each side; and at least one second contact which is disposed between adjacent ones of the high-speed differential signal lanes. Each of the first contacts, the ground contacts, and the second contact has a contacting portion to be connected to the connecting object and a terminal portion to be connected to a mounting object. Each of the first contacts is a contact for transmitting a high-speed electric signal containing a frequency component corresponding to a wavelength $\lambda$ satisfying $L>(\lambda/20)$ where L represents a length of the first contact from the contacting portion to the terminal portion. The second contact is a contact used when a signal to be transmitted does not contain a frequency component corresponding to a wavelength λ satisfying M>(λ/20) where M represents a length of the second contact from the contacting portion to the terminal portion. The connector has a first connection side for connection with the connecting object, where the contacting portions of the first contacts, the contacting portions of the ground contacts, and the contacting portion of the second contact are arranged in a single row at a distance from one another. The connector has a second connection side for connection with the mounting object, where the terminal portions of the first contacts and the terminal portions of the ground contacts are arranged in a first row at a distance wider than that between the contacting portions while the terminal portion of the second contact is arranged in a second row different from the first row. According to this configuration of the connector, the above-mentioned objects are achieved.

The terminal portions of the ground contacts sandwiching the second contact and arranged on opposite sides of the second contact may be combined with each other to form an integral structure.

Each of the first contacts and the ground contacts may have a distance changing portion for changing a distance between adjacent ones of the first contacts and the ground contacts from a distance between the contacting portions into a distance between the terminal portions. In this case, the distance changing portion may have a contact width wider than that of each of the contacting portions and the terminal portions.

Each of the high-speed differential signal lanes may have a symmetrical structure with respect to a plane between the two first contacts of the high-speed differential signal lane.

A plurality of the second contacts may be arranged between the high-speed differential signal lanes. In this case, the second contacts arranged between the high-speed differential signal lanes may be formed so that the distance between the terminal portions is wider than that between the contacting portions.

The first and the second rows may be parallel to each other.

The second contact may be one of a control signal contact, a power supply contact, a ground contact, or a signal transmission contact which does not belong to the high-speed differential signal lanes, for example a signal transmission contact for transmitting signals at some Mbps.

According to a signal transmission method of an aspect of the present invention, high-speed differential signal transmission is carried out by mounting one of the connectors to a board in order to achieve the object of the invention.

In the connector according to this invention, the terminal portions of the first contacts and the ground contacts are arranged in the same first row while the terminal portions of the second contacts are shifted in the second row. Therefore, the distance between adjacent ones of the terminal portions of the first contacts and the ground contacts can be widened correspondingly. Thus, it is possible to simultaneously achieve reduction in size of the connector and good mountability of the connector to a mounting object and to easily obtain matching of characteristic impedances so as to improve high-speed signal transmission characteristics.

DESCRIPTION OF THE PREFERRED EMBODIMENTS

Now, embodiments of a connector according to this invention will be described with reference to the drawings.

In the following description, a first direction A1 represents a direction in which a plurality of contacts are arranged. A second direction A2 is perpendicular to the first direction A1 and identical with a longitudinal direction of the contacts. A third direction A3 is perpendicular to the first and the second directions A1 and A2.

A connector 1 according to a first embodiment is a printed board mount connector adapted to be mounted to a printed board (mounting object) 80 and adapted to be fitted and connected to a mating connector (connecting object, not shown). In the following description, a front side of the connector 1 for connection with the mating connector (not shown) is called a first connection side while a bottom side of the connector 1 for connection with the printed board 80 is called a second connection side.

Figure 1:
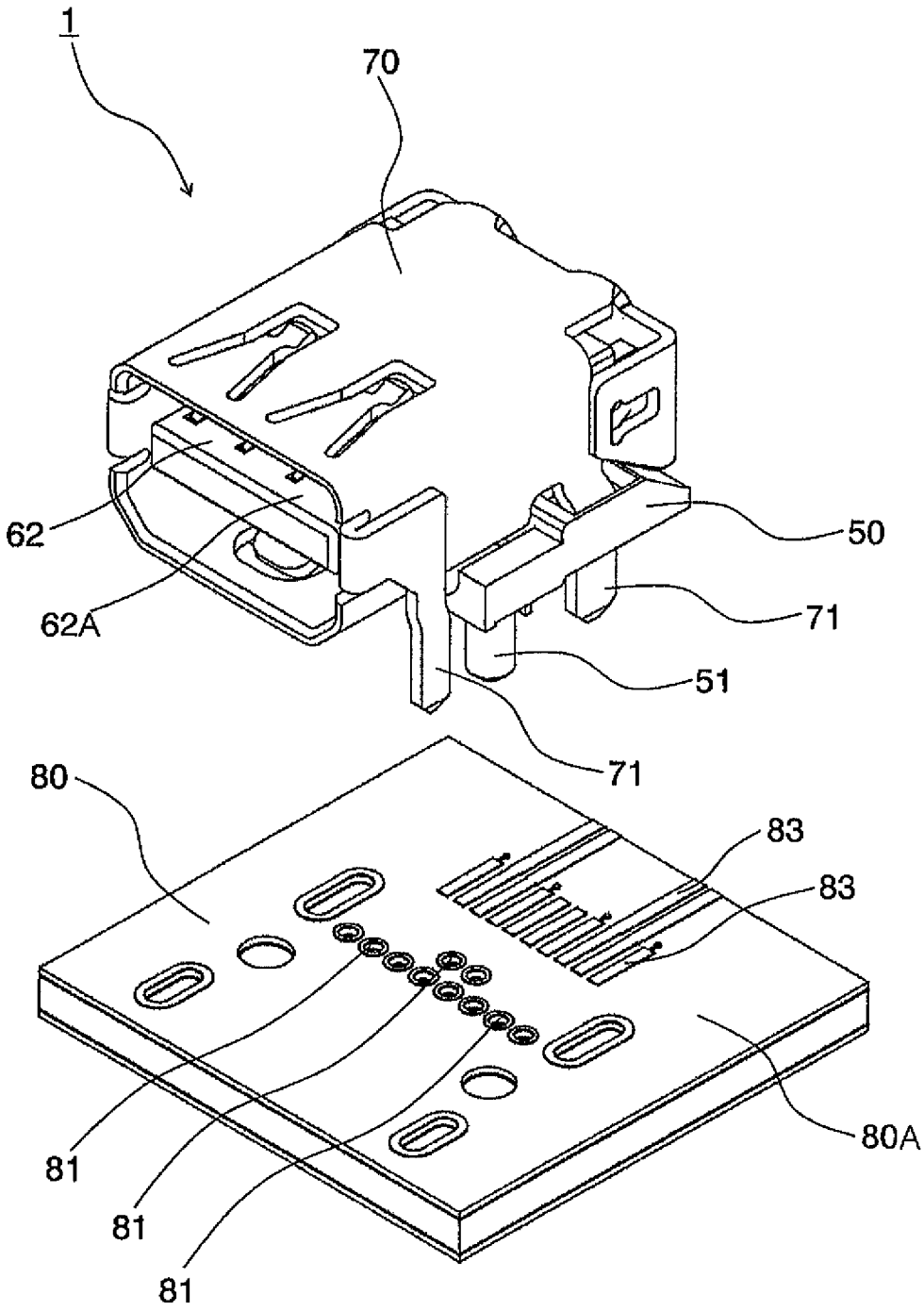
FIG. 1 is a perspective view of a connector according to a first embodiment of this invention in the state where it is used.
Figure 6:
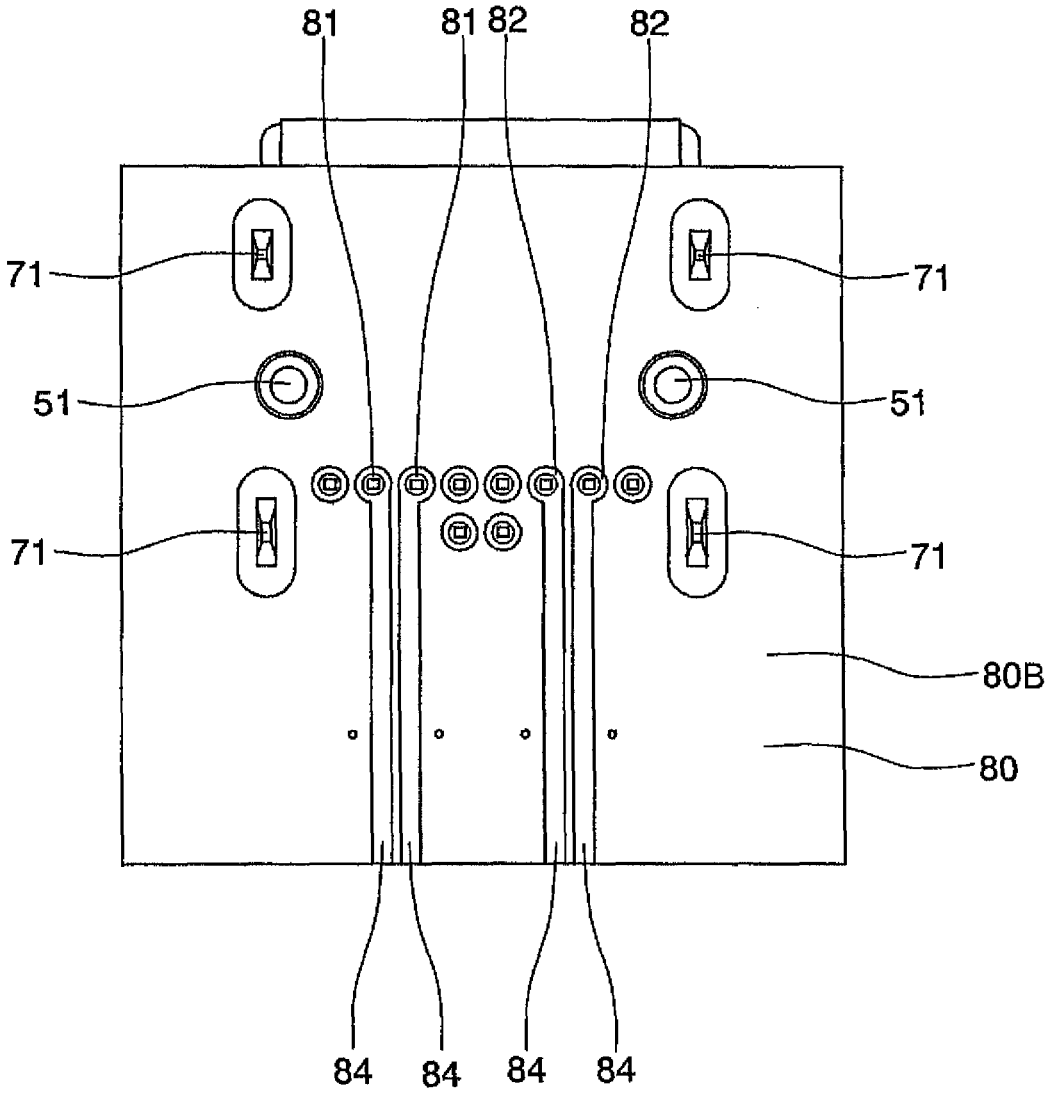
FIG. 6 is a plan view of the connector mounted to the printed board, as seen from a lower surface side of the printed board.

The printed board 80 used in this embodiment is a multilayer board. As shown in FIGS. 1 and 6, the printed board 80 is provided with a number of through holes 81. The printed board 80 has a lower surface 80B provided with a plurality of lands 82. Each of the lands 82 comprises a doughnut-shaped conductor pattern and is formed around an opening of each through hole 81. From some of the lands 82, a plurality of wiring patterns 84 are extracted along the printed board 80 in parallel to one another. Positions and functions of the through holes 81 will later become clear.

Figure 2:
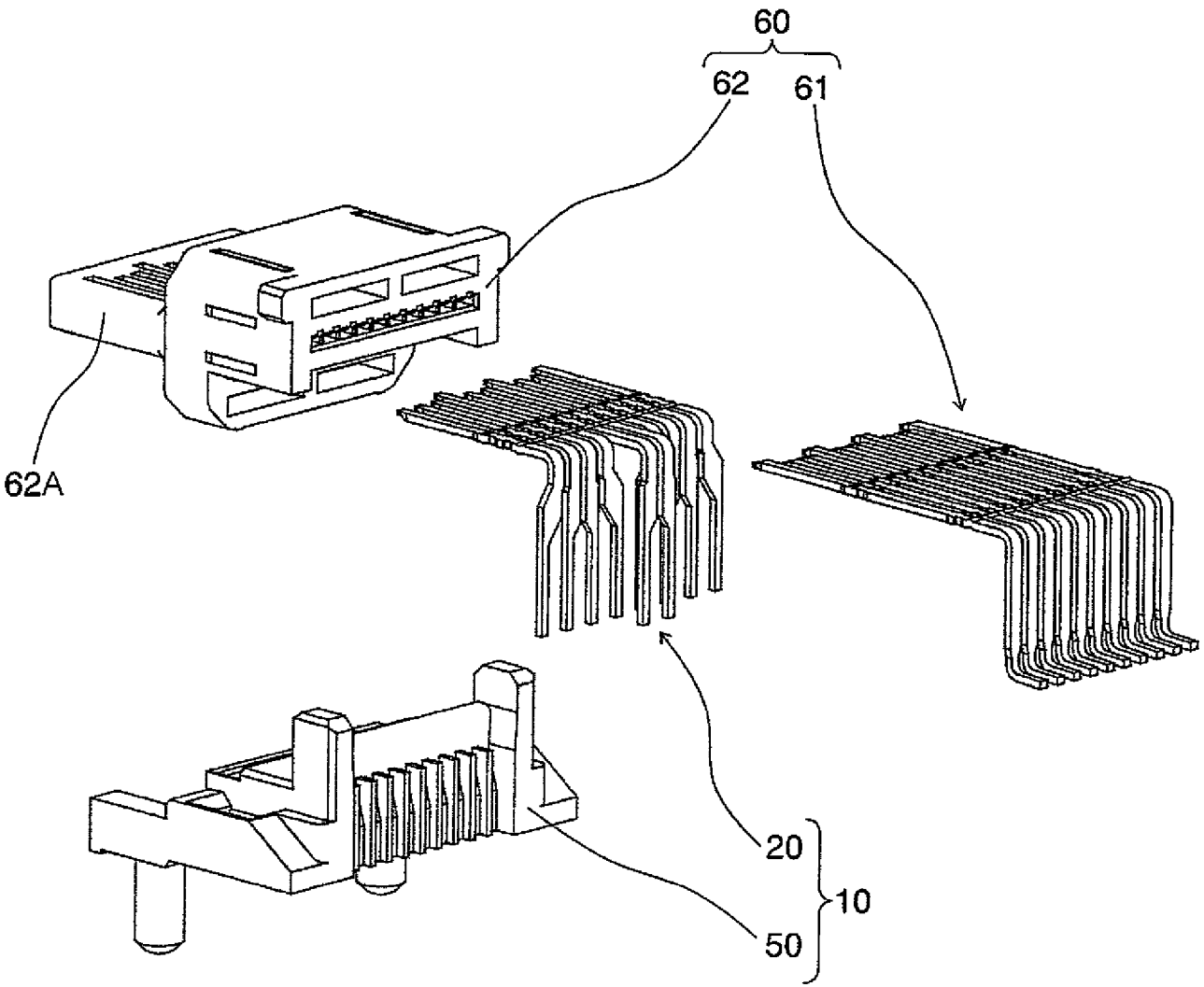
FIG. 2 is an exploded perspective view of the connector illustrated in FIG. 1.

As seen from FIGS. 1 and 2, the connector 1 comprises a lower contact assembly 10, an upper contact assembly 60, and a conductive shell 70 collectively covering the lower and the upper contact assemblies 10 and 60.

As shown in FIG. 2, the upper contact assembly 60 has an upper contact group 61 comprising a plurality of conductive contacts, and an insulating upper housing 62 holding the upper contact group 61. As shown in FIGS. 1 and 2, the upper housing 62 has a fitting protrusion 62A adapted to be fitted to the mating connector (not shown) on the first connection side of the connector 1. Each of the contacts of the upper contact group 61 has a front end arranged on an upper side of the fitting protrusion 62A of the upper housing 62, an intermediate portion extending rearward and then perpendicularly bent downward, and a lower end soldered to a wiring pattern 83 formed on an upper surface 80A of the printed board 80 by a SMT (Surface Mount Technology) structure.

As shown in FIG. 1, the shell 70 has a plurality of fixing legs 71 to be fixed to the printed board 80. By soldering the fixing legs 71 to the printed board 80, the connector 1 is fixed to the printed board 80.

Next, the lower contact assembly 10 will be described in detail.

As shown in FIG. 2, the lower contact assembly 10 has a lower contact group 20 comprising a plurality of conductive contacts 31, 32, and 40 (FIG. 3), and an insulating lower housing 50 holding the lower contact group 20 with the conductive contacts 31, 32, and 40 kept in an aligned state.

In the following, the contacts 31, 32, and 40 may be referred to as the first contacts 31, the ground contacts 32, and the second contacts 40, respectively.

Figure 3:
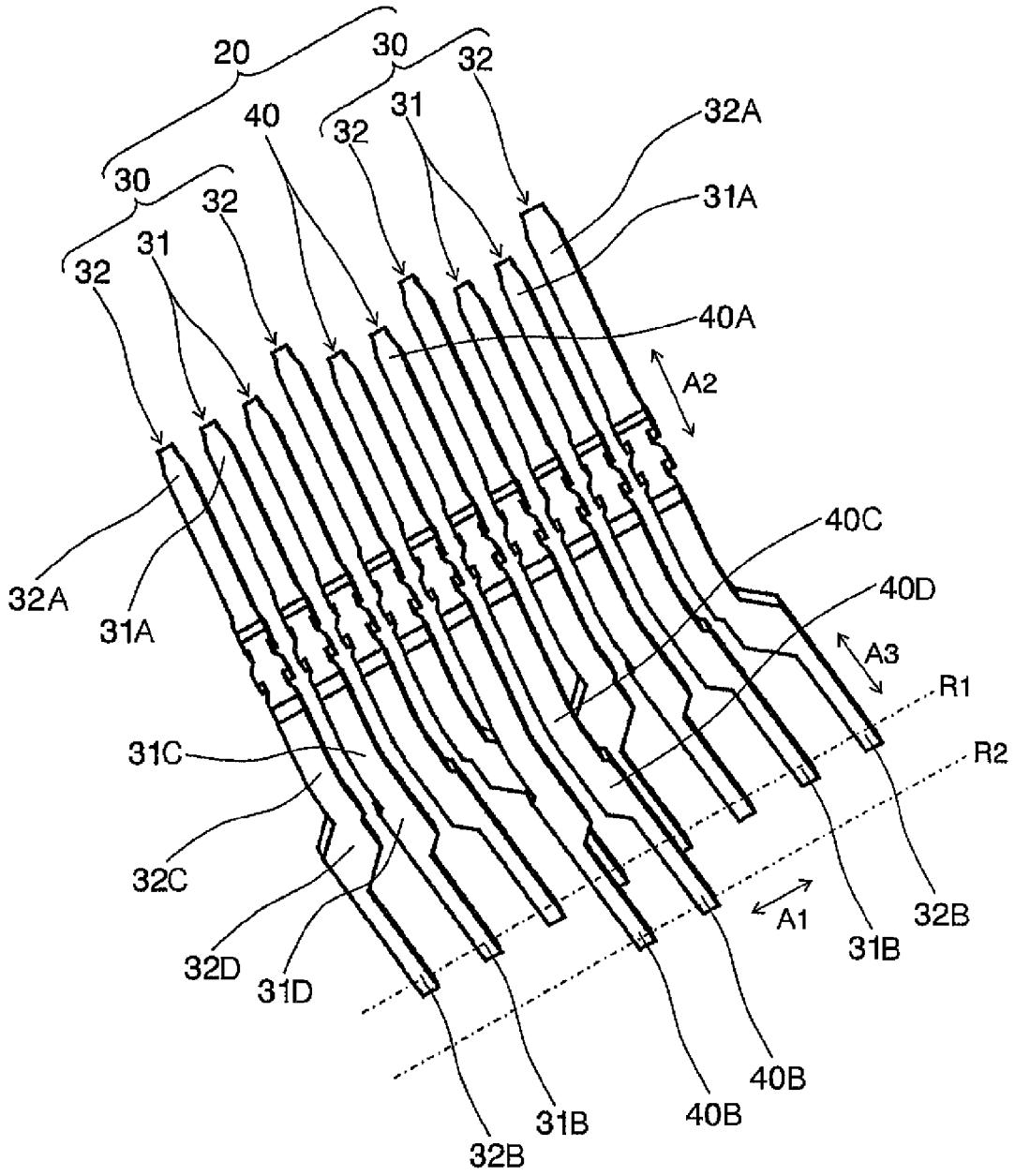
FIG. 3 is a perspective view of a lower contact group of the connector.
Figure 4:
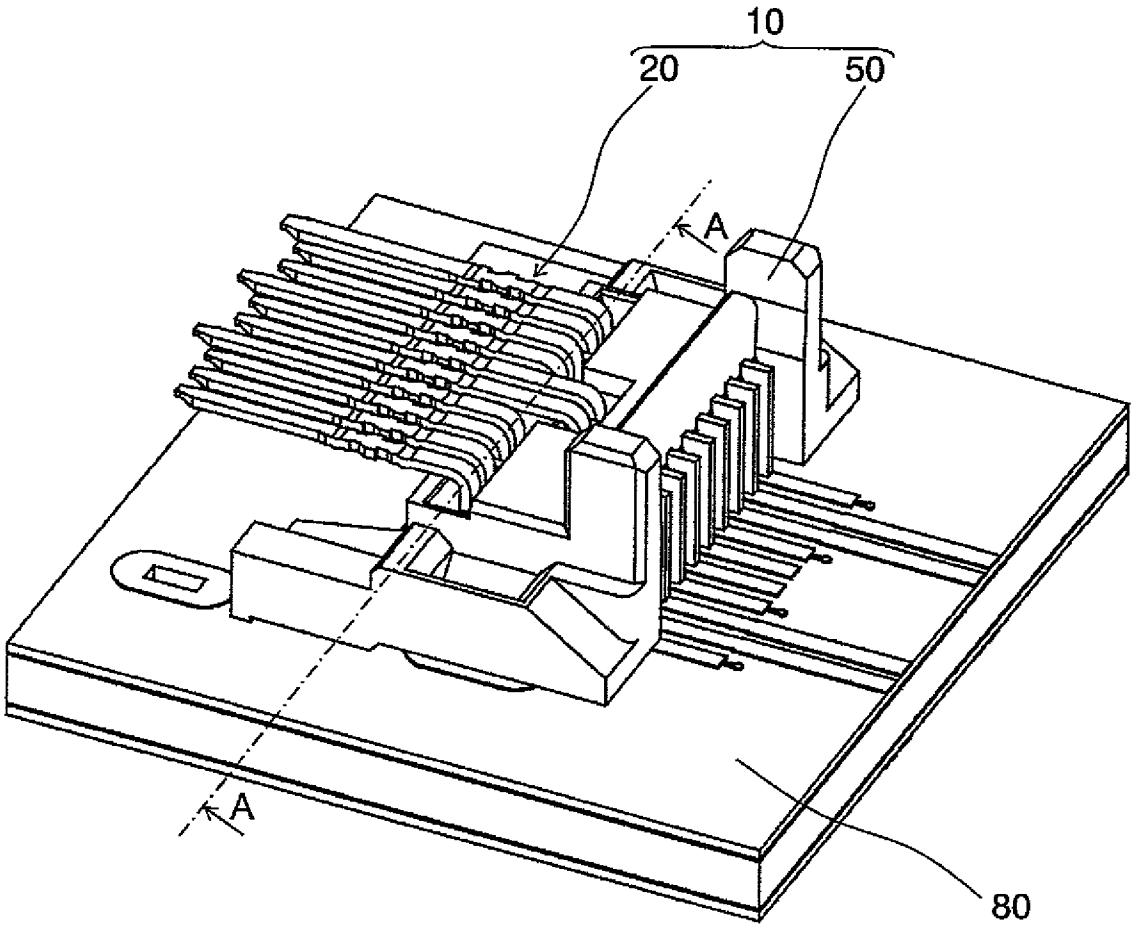
FIG. 4 is a perspective view showing the state where a lower contact assembly of the connector is mounted to a printed board.

As shown in FIG. 3, the lower contact group 20 comprises two high-speed differential signal lanes 30 and the two second contacts 40 disposed between the two high-speed differential signal lanes 30.

Each of the high-speed differential signal lanes 30 comprises the conductive contacts 31 and 32, four in total. More in detail, as shown in FIG. 3, each high-speed differential signal lane 30 comprises a pair of the first contacts 31, two in number, arranged adjacent to each other and the ground contacts 32, two in number, disposed on opposite sides of the pair of the first contacts 31, one on each side. The ground contacts 32 are not limited to contacts exclusively for grounding but may be any contacts exhibiting an electric function equivalent to grounding when the high-speed differential signal lane 30 is formed. For example, power supply contacts may be used. The pair of the two first contacts 31 forms a differential signal pair for transmitting a high-speed differential signal (for example, 10 Gbps or higher-speed). Each of the first contacts 31 is adapted to transmit a high-speed electric signal containing a frequency component corresponding to a wavelength $\lambda$ satisfying $L>(\lambda/20)$ where L represents a contact size of the first contact 31 (i.e., the length from a contacting portion 31A to a terminal portion 31B of the first contact 31). In order to improve transmission characteristics of the high-speed differential signal lanes 30, each of the high-speed differential signal lanes 30 has a symmetrical structure with respect to a plane between the two first contacts 31 of the high-speed differential signal lane 30 (i.e., a plane defined by the second direction A2 and the third direction A3).

The second contacts 40 do not belong to the high-speed differential lanes 30 (that is, the second contacts 40 are not for use in high-speed signal transmission). Specifically, the second contacts 40 may be control signal contacts, power supply contacts, ground contacts, or signal transmission contacts which do not belong to the high-speed differential signal lanes 30 (for example, signal transmission contacts for signal transmission at a speed on the order of Mbps). Each of the second contacts 40 is adapted to be used when a signal to be transmitted does not contain a frequency component corresponding to a wavelength $\lambda$ satisfying $M>(\lambda/20)$ where M represents a contact size of the second contact 40 (i.e., the length from a contacting portion 40A to a terminal portion 40B of the second contact 40). In this embodiment, the contact size L of the first contact 31 is designed to be equal or substantially equal to the contact size M of the second contact 40.

As shown in FIG. 3, the contacts 31, 32, and 40 of the lower contact group 20 have the contacting portions 31A, 32A, and 40A to be connected to the mating connector (not shown), the terminal portions 31B, 32B, and 40B to be connected to the printed board 80, bent portions 31C, 32C, and 40C formed between the contacting portions 31A, 32A, and 40A and the terminal portions 31B, 32B, and 40B, respectively, and distance changing portions 31D, 32D, and 40D formed between the bent portions 31C, 32C, and 40C and the terminal portions 31B, 32B, and 40B, respectively.

On the first connection side of the connector 1, the contacting portions 31A, 32A, and 40A are arranged in a single row along the first direction A1 at a distance from one another and are disposed on a lower side of the fitting protrusion 62A of the upper housing 62.

Figure 5:
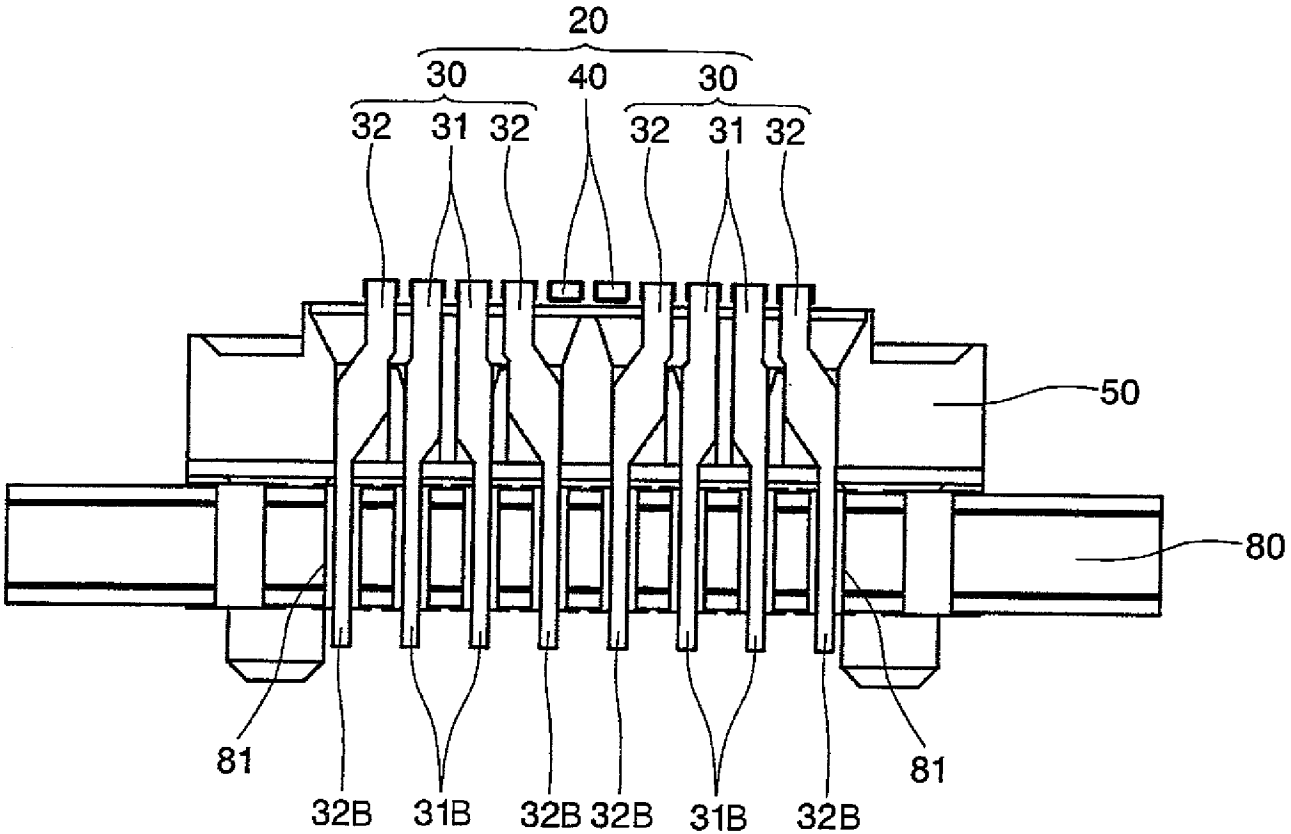
FIG. 5 is a sectional view taken along a line A-A in FIG. 4 as seen in an arrow direction.

As shown in FIG. 5, the terminal portions 31B, 32B, and 40B are inserted into the through holes 81 of the printed board 80 on the second connection side of the connector 1 and connected to the lands 82 by soldering on the lower surface 80B of the printed board 80.

As shown in FIG. 3, the terminal portions 31B and 32B of the first contacts 31 and the ground contacts 32 are arranged in the first row R1 along the first direction A1 at a distance from one another. On the other hand, the terminal portions 40B of the two second contacts 40 are arranged in the second row R2 shifted rearward from the first row R1 in the second direction A2 at a distance from one another, as shown in FIG. 3.

The bent portions 31C, 32C, and 40C are formed by perpendicularly bending the contacts 31, 32, and 40, respectively. It is noted here that bending angles of the bent portions 31C, 32C, and 40C are not limited to 90°.

As shown in FIG. 3, the first contacts 31 and the ground contacts 32 have the distance changing portions 31D and 32D formed between the bent portions 31C and 32C and the terminal portions 31B and 32B, respectively. With this structure, the distance between adjacent ones of the terminal portions 31B and 32B of the first contacts 31 and the ground contacts 32 is widened, as compared with the distance between adjacent ones the contacting portions 31A and 32A of the first contacts 31 and the ground contacts 32, so as to be matched with the distance between adjacent ones of the through holes 81 on the printed board 80. As shown in FIG. 3, each of the second contacts 40 has the distance changing portion 40D formed between the bent portion 40C and the terminal portion 40B. With this structure, the distance between the terminal portions 40B of the two second contacts 40 is widened, as compared with the distance between the contacting portions 40A of the two second contacts 40, so as to be matched with the distance between the through holes 81. As shown in FIG. 3, the distance changing portions 31D, 32D, and 40D have contact widths wider than those of the remaining portions of the contacts 31, 32, and 40 so as to facilitate matching of the characteristic impedances.

The lower housing 50 holds the lower contact group 20 in an aligned state and, as shown in FIG. 1, has positioning bosses 51 formed on its lower surface to position the connector 1 with respect to the printed board 80.

In the connector 1 according to the first embodiment described above, the terminal portions 31B and 32B of the first contacts 31 and the ground contacts 32 are arranged in the first row R1 while the terminal portions 40B of the second contacts 40 are arranged in the second row R2. Thus, the distance between adjacent ones of the terminal portions 31B and 32B of the first contacts 31 and the ground contacts 32 is wider than that between adjacent ones of the contacting portions 31A and 32B of the first contact 31 and the ground contacts 32.

Thus, the terminal portions 31B and 32B of the first contacts 31 and the ground contacts 32 are arranged in the same first row R1 while the terminal portions 40B of the second contacts 40 are shifted to the second row R2. Therefore, the distance between adjacent ones of the terminal portions 31B and 32B of the first contacts 31 and the ground contacts 32 is widened correspondingly.

As a result, it is possible to simultaneously achieve reduction in size of the connector 1 and good mountability of the connector 1 to the printed board 80 and to easily obtain matching of characteristic impedances of the first contacts 31 and the ground contacts 32 so as to improve high-speed signal transmission characteristics.

Next referring to FIG. 7, a second embodiment of this invention will be described. In the following, a difference from the first embodiment will only be described and components similar in function to those of the first embodiment are designated by the same reference symbols.

Figure 7:
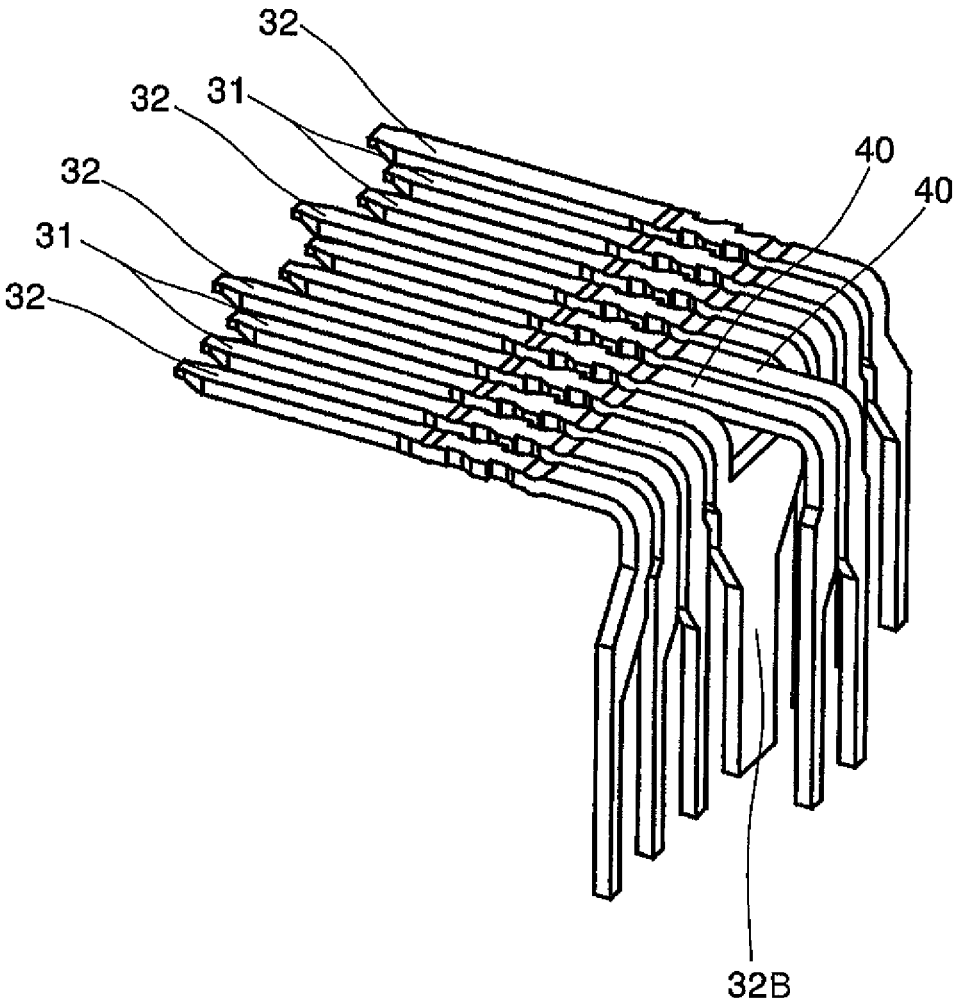
FIG. 7 is a perspective view of a lower contact group to be incorporated into a connector according to a second embodiment of this invention.

In the second embodiment of this invention, the terminal portions 32B of the ground contacts 32 sandwiching the pair of the second contacts 40 and arranged on opposite sides of the pair of the second contacts 40 are combined with each other to form an integral structure, as shown in FIG. 7.

In the second embodiment described above, the two ground contacts 32 are combined into a single component. With this structure, the number of components is reduced. In addition, the number of the through holes 81 of the printed board 80 for insertion of the terminal portions 32B of the ground contacts 32 is reduced and the number of times of soldering during mounting of the connector 1 to the printed board 80 is reduced also. Thus, it is possible to reduce a load imposed during manufacture and mounting of the connector 1.

Next referring to FIG. 8, a third embodiment of this invention will be described. In the following, a difference from the first embodiment will only be described and components similar in function to those of the first embodiment are designated by the same reference symbols.

Figure 8:
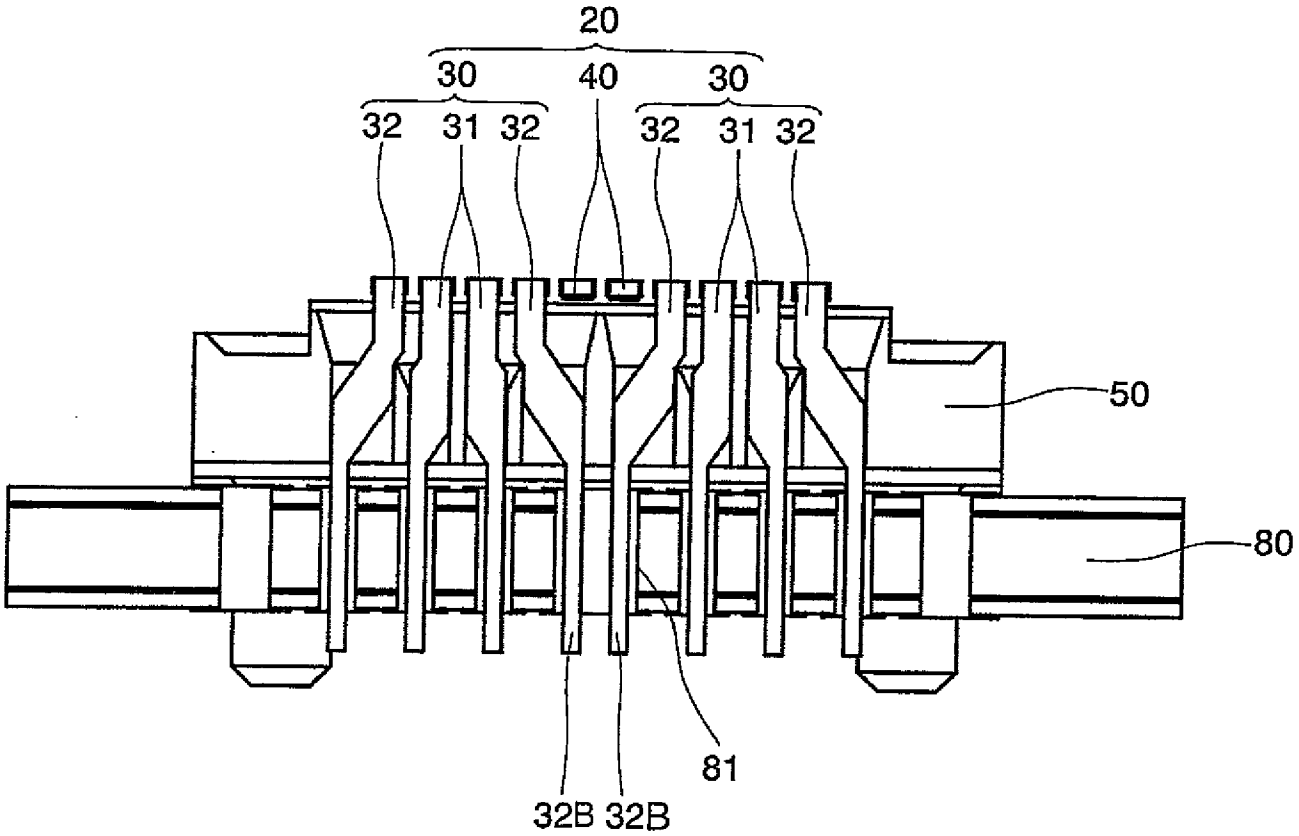
FIG. 8 is a sectional view similar to FIG. 5 and showing the state where a lower contact assembly of a connector according to a third embodiment of this invention is mounted to a printed board.
Figure 9:
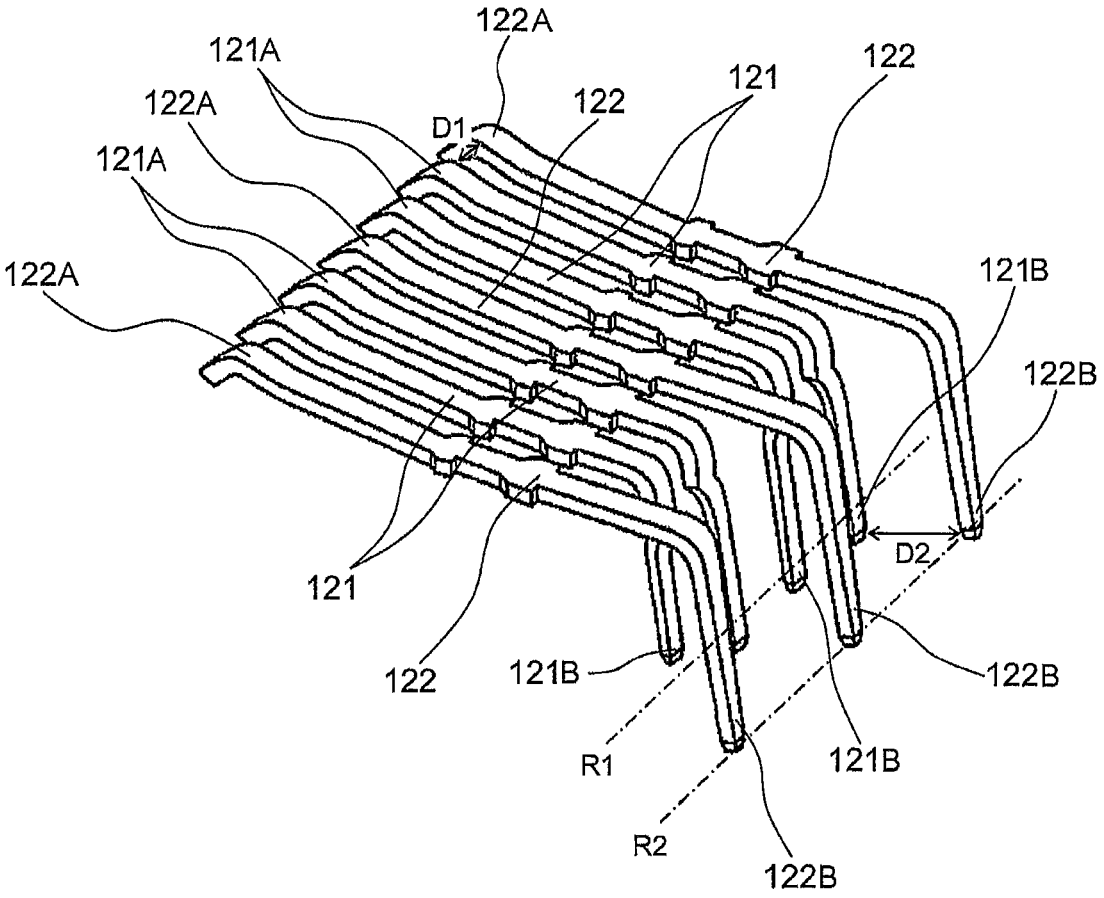
FIG. 9 Prior Art
FIG. 9 is a perspective view of a lower contact group to be incorporated into a conventional connector.

In the third embodiment, the terminal portions 32B of the ground contacts 32 sandwiching the pair of the second contacts 40 and arranged on the opposite sides of the pair of the second contacts 40 are inserted into a common through hole 81 of the printed board 80, as shown in FIG. 8.

In the third embodiment described above, the number of the through holes 81 of the printed board 80 for insertion of the terminal portions 32B of the ground contacts 32 is reduced and the number of times of soldering during mounting of the connector 1 to the printed board 80 is reduced also. Thus, it is possible to reduce a load imposed during manufacture and mounting of the connector 1.

In the foregoing embodiments, description has been made about the case where the connector has two high-speed differential signal lanes each of which comprises the two first contacts and the two ground contacts. However, three or more high-speed differential signal lanes may be provided. In this event, the second contacts are disposed between every adjacent ones of the high-speed differential signal lanes.

In the foregoing embodiments, the number of the second contacts arranged between the high-speed differential signal lanes is equal to two. However, the number of the second contacts arranged between the high-speed differential signal lanes may be any number not smaller than one.

In the foregoing embodiments, the terminal portions of the first contacts and the ground contacts are arranged in the first row located frontward in the second direction than the second row in which the terminal portions of the second contacts are arranged. Alternatively, the terminal portions of the first contacts and the ground contacts may be arranged rearward in the second direction than the terminal portions of the second contacts.

What is claimed is:

1. A connector to be mounted to a mounting object and connected to a connecting object, the connector comprising:

a plurality of high-speed differential signal lanes, each signal lane of the plurality of high-speed differential signal lanes being composed of two first contacts adapted to high-speed differential signal transmission and arranged adjacent to each other and two ground contacts sandwiching the two first contacts and arranged on opposite sides of the two first contacts, one on each side; and at least one second contact disposed between adjacent ones of the high-speed differential signal lanes and not belonging to the high-speed differential signal lanes;

each of the first contacts, the ground contacts, and the second contact having a contacting portion to be connected to the connecting object and a terminal portion to be connected to the mounting object;

the connector having a first connection side for connection with the connecting object, where the contacting portions of the first contacts, the contacting portions of the ground contacts, and the contacting portion of the second contact are arranged in a single row at a contacting distance from one another;

the connector having a second connection side for connection with the mounting object, where the terminal portions of the first contacts and the terminal portions of the ground contacts are arranged in a first row at a terminal distance from one another, the terminal distance being wider than the contacting distance, while the terminal portion of the second contact is arranged in a second row different from the first row.

2. The connector according to claim 1, wherein the terminal portions of the ground contacts sandwiching the second contact and arranged on opposite sides of the second contact are combined with each other to form an integral structure.

3. The connector according to claim 1, wherein:

each of the first contacts and the ground contacts has a distance changing portion for changing a distance between adjacent ones of the first contacts and the ground contacts from the contacting distance into the terminal distance;

the distance changing portion having a first contact width, the contacting portions having a second contact width, and the terminal portions having a third contact width, the first contact width being wider than the second contact width and being wider than the the third contact width.

4. The connector according to claim 1, wherein each of the high-speed differential signal lanes has a symmetrical structure with respect to a plane between the two first contacts of the high-speed differential signal lane.

5. The connector according to claim 1, wherein:

a plurality of the second contacts are arranged between the high-speed differential signal lanes;

the second contacts arranged between the high-speed differential signal lanes being formed so that a second contact terminal distance is between the terminal portions of the second contacts and so that a second contact contacting distance is between the contacting portions of the second contacts, the second contact terminal distance being wider than the second contact contacting distance.

6. The connector according to claim 1, wherein the first and the second rows are parallel to each other.

7. The connector according to claim 1, wherein the second contact is one of a control signal contact, a power supply contact, a ground contact, or a signal transmission contact not belonging to the high-speed differential signal lanes.

8. A signal transmission method of carrying out high-speed differential signal transmission by mounting a connector according to claim 1 to a board.

9. A connector to be mounted to a mounting object and connected to a connecting object, the connector comprising:

a plurality of high-speed differential signal lanes, each signal lane of the plurality of high-speed differential signal lanes being composed of two first contacts arranged adjacent to each other and two ground contacts sandwiching the two first contacts and arranged on opposite sides of the two first contacts, one on each side; and at least one second contact disposed between adjacent ones of the high-speed differential signal lanes;

each of the first contacts, the ground contacts, and the second contact having a contacting portion to be connected to the connecting object and a terminal portion to be connected to the mounting object;

each of the first contacts being a contact for transmitting a high-speed electric signal containing a frequency component corresponding to a wavelength $\lambda$ satisfying $L>(\lambda/20)$ where L represents a length of the first contact from the contacting portion to the terminal portion;

the second contact being a contact used when a signal to be transmitted does not contain a frequency component corresponding to a wavelength $\lambda$ satisfying $M>(\lambda/20)$ where M represents a length of the second contact from the contacting portion to the terminal portion;

the connector having a first connection side for connection with the connecting object, where the contacting portions of the first contacts, the contacting portions of the ground contacts, and the contacting portion of the second contact are arranged in a single row at a contacting distance from one another;

the connector having a second connection side for connection with the mounting object, where the terminal portions of the first contacts and the terminal portions of the ground contacts are arranged in a first row at a terminal distance from one another, the terminal distance being wider than the contacting distance, while the terminal portion of the second contact is arranged in a second row different from the first row.

10. The connector according to claim 9, wherein the terminal portions of the ground contacts sandwiching the second contact and arranged on opposite sides of the second contact are combined with each other to form an integral structure.

11. The connector according to claim 9, wherein:

each of the first contacts and the ground contacts has a distance changing portion for changing a distance between adjacent ones of the first contacts and the ground contacts from the contacting distance into the terminal distance;

the distance changing portion having a first contact width, the contacting portions having a second contact width, and the terminal portions having a third contact width, the first contact width being wider than the second contact width and being wider than the third contact width.

12. The connector according to claim 9, wherein each of the high-speed differential signal lanes has a symmetrical structure with respect to a plane between the two first contacts of the high-speed differential signal lane.

13. The connector according to claim 9, wherein:

a plurality of the second contacts are arranged between the high-speed differential signal lanes;

the second contacts arranged between the high-speed differential signal lanes being formed so that a second contact terminal distance is between the terminal portions of the second contacts and so that a second contact contacting distance is between the contacting portions of the second contacts, the second contact terminal distance being wider than the second contact contacting distance.

14. The connector according to claim 9, wherein the first and the second rows are parallel to each other.

15. The connector according to claim 9, wherein the second contact is one of a control signal contact, a power supply contact, a ground contact, or a signal transmission contact not belonging to the high-speed differential signal lanes.

16. A signal transmission method of carrying out high-speed differential signal transmission by mounting a connector according to claim 9 to a board.

* * * * *